US008991120B2

(12) United States Patent
Lehane, Jr. et al.

(10) Patent No.: US 8,991,120 B2
(45) Date of Patent: Mar. 31, 2015

(54) TWO-PART CHANNEL CROSS MEMBER

(71) Applicant: USG Interiors, LLC, Chicago, IL (US)

(72) Inventors: James J. Lehane, Jr., McHenry, IL (US); Peder J. Gulbrandsen, Aurora, IL (US); Mark R. Paulsen, Waukegan, IL (US); Abraham M. Underkofler, Waukegan, IL (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 13/960,042

(22) Filed: Aug. 6, 2013

(65) Prior Publication Data

US 2015/0040494 A1 Feb. 12, 2015

(51) Int. Cl.
*E04C 2/52* (2006.01)
*E04B 9/12* (2006.01)

(52) U.S. Cl.
CPC ..... *E04B 9/122* (2013.01)
USPC ..... 52/220.6; 52/506.07

(58) Field of Classification Search
USPC ..... 52/220.6, 506.06–506.1
See application file for complete search history.

(56) References Cited

U.S. PATENT DOCUMENTS

| | | | | | |
|---|---|---|---|---|---|
| 3,295,284 | A * | 1/1967 | Tschiesche | ..... | 52/506.07 |
| 3,594,972 | A * | 7/1971 | Jones et al. | ..... | 52/716.1 |
| 3,871,150 | A * | 3/1975 | Murray et al. | ..... | 52/779 |
| 4,206,578 | A * | 6/1980 | Mieyal | ..... | 52/506.07 |
| 4,742,662 | A * | 5/1988 | Smith | ..... | 52/718.01 |
| 4,794,745 | A * | 1/1989 | Platt et al. | ..... | 52/506.07 |
| 4,838,002 | A * | 6/1989 | Dajnko et al. | ..... | 52/475.1 |
| 5,535,566 | A * | 7/1996 | Wilson et al. | ..... | 52/506.07 |
| 6,536,173 | B2 * | 3/2003 | Rebman | ..... | 52/465 |
| D656,006 | S | 3/2012 | Underkofler et al. | | |
| D656,251 | S | 3/2012 | Underkofler et al. | | |
| 8,176,700 | B2 * | 5/2012 | Butcher et al. | ..... | 52/506.07 |
| 8,359,801 | B2 * | 1/2013 | Lehane et al. | ..... | 52/506.07 |
| 2012/0137615 | A1 * | 6/2012 | Wendt | ..... | 52/506.07 |

* cited by examiner

*Primary Examiner* — Adriana Figueroa
(74) *Attorney, Agent, or Firm* — Pearne & Gordon LLP

(57) ABSTRACT

A cross member for a narrow channel in a suspended ceiling grid comprising a carrier and a cover, the carrier having a web and a planar flange on a lower edge of the web, end connectors at opposite ends of the carrier web, the cover having a three-dimensional cross-section with an overall width generally equal to the width of the carrier flange and integral bendable tabs, the tabs being adjacent the ends of the cover and short in comparison to a length of the cover, the tabs being constructed to be manually folded over the flange of the carrier to lock the cover to the carrier.

5 Claims, 2 Drawing Sheets

TWO-PART CHANNEL CROSS MEMBER

BACKGROUND OF THE INVENTION

The invention relates to suspended ceiling construction and, in particular, to grid elements used with narrow utility channel systems.

PRIOR ART

Narrow channel systems are available for housing or otherwise locating various utility hardware in a conventional rectangular ceiling grid and tile construction. The channels are viewed as more harmonious or attractive than conventional arrangements for locating lights, air diffusers and returns, sprinklers and the like. Conventional arrangements, for example, dedicate a full grid module space to a single utility and, consequently, are more visually prominent than what is ordinarily needed to house a particular utility. The subject narrow channel systems, besides reducing the visibility of necessary utilities, can add to the attractiveness of a ceiling.

It is known to construct narrow utility channels by aligning a pair of conventional main runners or tees in close parallel relation. A number of inverted U-shaped yokes, spaced along the length of these main tees can be used to hold these main tees in parallel channel-forming relation at the ceiling plane. The yokes are located above the zone of the channel to provide space for utility hardware. This type of construction presents a need for a manner of trimming the ends of the hardware located in the channel such as panels, lights, grills or the like. Use of short cross runners or tees with conventional end connections for this purpose has proven to be difficult if not impractical.

SUMMARY OF THE INVENTION

The invention provides a cross member for narrow suspended ceiling channels which include a bulbous or three-dimensional lower flange. The cross member is useful for trimming the ends of typical utility components assembled in the channels while visually matching the profile of the surrounding suspended grid network. In accordance with the invention, a cross member with a three-dimensional lower flange can be constructed in two parts using a cross member carrier with a flat or two-dimensional flange and a three-dimensional cover. The preferred cover is arranged to be field mounted on the carrier after the carrier has been installed in the channel, typically in cross runner slots in main runners forming the channel.

The two-part cross member facilitates its assembly into a narrow channel because the visible three-dimensional cover part can be located with simple vertical motion onto the carrier part. Consequently, whereas the carrier part may require manipulation in a plane or planes to insert its ends in a pair of opposed cross runner slots, the three-dimensional cover part need not be subjected to the same. These separate installation steps can be, in total, less demanding in time and skill than what could be required if a single part was used.

In the disclosed embodiment, the carrier part has the shape of a conventional grid tee with an upper reinforcing bulb, a vertical web below the bulb, and a horizontal flange at a lower edge of the web. Advantageously, the end connectors are integrally stamped from the web material. The cover part is a U-shaped sheet metal channel stamping with out-turned narrow horizontal flanges on upper edges of the sides of the channel section. Local bendable tabs, integral with the flanges, are used to lock the cover in place on the carrier.

DESCRIPTION OF THE PREFERRED EMBODIMENT

Figure 1:
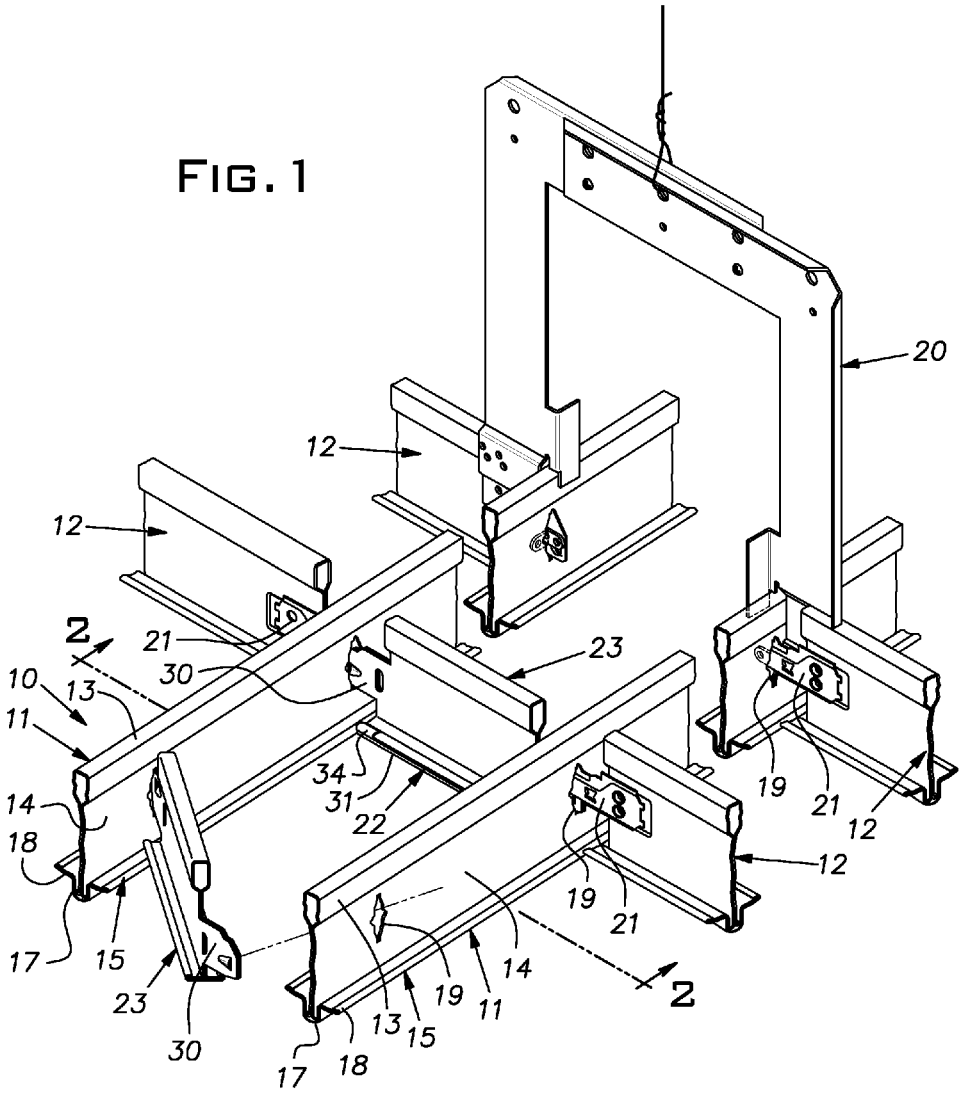
FIG. 1 is a fragmentary isometric view of a narrow ceiling utility channel in which the inventive two-part cross member is installed.
Figure 2:
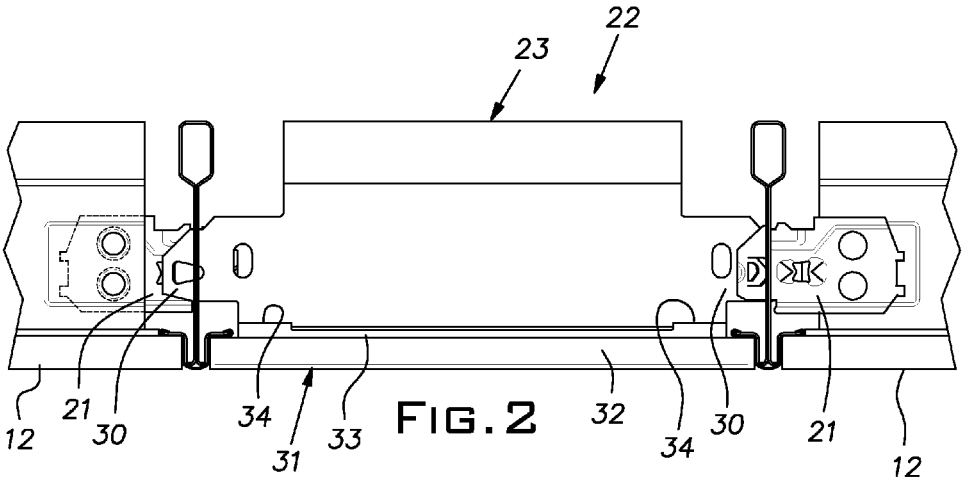
FIG. 2 is a side view of the two-part cross member taken in the plane 2-2 indicated in FIG. 1.

FIG. 1 illustrates a narrow channel 10 formed of a pair of parallel main runners 11. For visual harmony, the main runners 11 forming the channel 10, as is typical, have the same visible cross-section as that of the grid members of a suspended ceiling in which the channel is integrated. This commonality is represented by cross runners 12 of the suspended ceiling that intersect the channel main runners 11. The illustrated runners 11 and 12 are of the type disclosed in U.S. Pat. No. 8,359,801. The main runners 11 are elongated roll formed sheet metal members having an upper hollow reinforcing bulb 13, a vertical web 14 and a flange 15. The flange 15, unlike a common grid tee flat or planar flange, is three-dimensional, having a U-shaped hollow center 17 and outwardly extending generally horizontal ribs 18.

The main runner webs 14, as is normal, have regularly spaced vertical slots 19 for receiving end connectors 21 of intersecting cross runners 12. The opposed slots 19 of the main runners 11 are aligned with one another. The main runners 11 are held in spaced parallel alignment by suitable structure such as a plurality of longitudinally spaced inverted U-shaped yokes (only one is shown in FIG. 1) outside and above the channel 10.

Commonly, the narrow channel 10 is constructed before any cross members to be associated with it are installed. With the channel 10 being, for example, 4 inches or 6 inches wide, as measured center-to-center between the runners 11 (or their metric equivalent of 100 and 150 mm), installation of cross members 22 to trim the ends of utility hardware in the channel 10 can be problematic.

Figure 4:
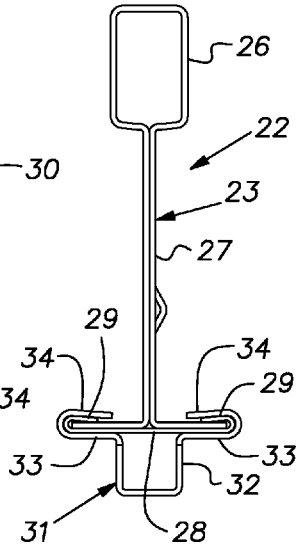
FIG. 4 is an end view of the two-part cross member.

The present invention comprehends a two-part cross member 22. A first part 23 of the cross member which serves as a carrier can have a conventional tee cross-section with a flat two-dimensional flange configuration. This description applies to the illustrated arrangement in FIG. 4 where the flange, designated 24, has two plies. One ply is made by the main body sheet which also forms an upper hollow reinforcing bulb 26, and a web 27. The second ply is formed by a cap sheet 28 having its longitudinal edges folded up into hems 29 over the longitudinal edges of the main body sheet flange ply.

The carrier 23 can be formed by cutting short lengths of regular cross tee stock. The carrier 23 can have integral end connectors 30 stamped out of the web area of the tee stock.

Figure 3:
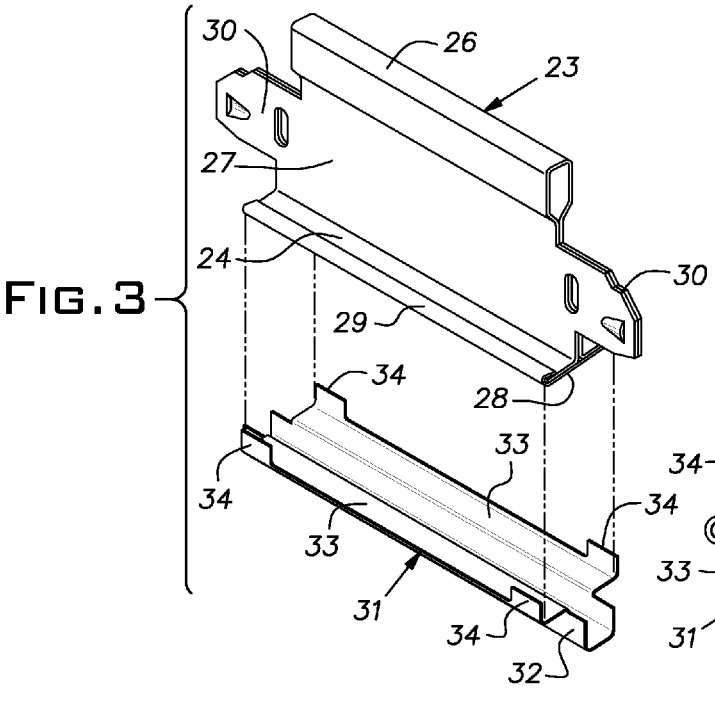
FIG. 3 is a exploded perspective view of the two-part cross member.

The other cross member part is a cover 31 having a shape of the lower visible face of the main runners 11 forming the channel 10 (as well as the cross tees or runners 12). Referring to FIG. 3, the cover 31, formed of malleable sheet metal, has a U-shaped center 32 and narrow outwardly directed upper ribs 33. At each end, the center section 32 projects axially beyond the ribs or flanges 33 a distance equal to the width of the ribs. At each end of a rib 33, the cover 31 has an integral rectangular tab 34. The cover 31 can be supplied to the installer with the tabs 34 upstanding as shown in FIG. 3.

In accordance with the invention, the carrier 23 of the cross member 22 is fully installed in the channel 10 before the cover 31 is assembled. In reference to FIG. 1, the installation of the carrier 23 can begin with insertion of one end connector 30 into a selected cross runner slot 19. The opposite or second end connector 30 can be bent to foreshorten the carrier 23 and enable it, with the one end connector 30 fully inserted in a cross runner slot 19, to fit between the main runner webs 14 of the channel 10. The carrier end connectors 30 are proportioned with respect to the main runner slot 19 to support the carrier flange 24 in a common plane with the main runner flanges 15. The length of the carrier flange 24 is proportioned so that its end edges abut longitudinal edges of the main runner flanges 15. When the carrier 22 is diagonally disposed in the channel 10 at the beginning of its assembly in the channel, the corners of its flanges 24 can be resiliently deflected so as to overlie and slide over the main runner flanges 15 to the extent necessary.

With the second end connector 30 fully received in its respective slot 19, the cover 31 is assembled on the carrier 23. This is accomplished by aligning the cover 31 below the carrier 23 and raising it vertically between the channel main runners 11 until its ribs 33 abut the carrier flange 24.

The ends of the cover center 32 are proportioned to fit below the main runner ribs 18 and abut the vertical side of the flange centers 17. When the cover 31 is properly positioned, the tabs 34 are manually bent inwardly over the carrier flange 24 to lock the cover 31 in place on the carrier 23. It will be understood from the foregoing that the cover 31 fits in place without extraneous manipulation that would risk scratching the visible painted sides of the main runner flange center 17.

The selected position of a cross member 22 will correspond to the end of a utility device or panel requiring a finished or integrated look and usually will be in line with a pair of cross runners 12. Note that the slots 19 are wide enough to receive the end connectors 21 of the cross runners as well as the end connectors 30 of the cross member carrier 23. Thus, the cross member 22 will continue the visual line transversely across the channel 10.

It should be evident that this disclosure is by way of example and that various changes may be made by adding, modifying or eliminating details without departing from the fair scope of the teaching contained in this disclosure.

The invention is therefore not limited to particular details of this disclosure except to the extent that the following claims are necessarily so limited.

What is claimed is:

1. A cross member for a narrow channel in a suspended ceiling grid comprising a carrier and a cover, the carrier having a web and a planar flange on a lower edge of the web, the flange comprising two plies, one of the plies being integral with a main body sheet forming an upper hollow reinforcing bulb and said web, the other of said plies being formed by a cap sheet having longitudinal edges folded up into hems over longitudinal edges of the main body sheet whereby the carrier has the cross-sectional structure of a regular cross tee, end connectors at opposite ends of the carrier web, the cover having a three-dimensional cross-section with an overall width generally equal to the width of the carrier flange and four separate integral bendable tabs, the tabs being disposed on opposite edges of the cover and spaced from each end of the cover, each tab being short in a lengthwise direction of the cover in comparison to a length of the cover such that the tabs on each edge of the cover are spaced from one another a distance greater than the length of each tab, the tabs by virtue of their short length and wide spacing being constructed to be manually folded over the flange of the carrier while the carrier is installed in the channel to lock the cover to the carrier.

2. A cross member as set forth in claim 1 being sized to fit in a channel having a nominal width of 4 or 6 inches or 100 or 150 mm.

3. A cross member as set forth in claim 1, wherein each end of the cover extends beyond respective ends of the flanges of the carrier.

4. A cross member for a narrow channel in a suspended ceiling grid comprising a carrier and a cover, the carrier having a web and a planar flange on a lower edge of the web, the flange comprising two plies, one of the plies being integral with a main body sheet forming an upper hollow reinforcing bulb and said web, the other of said plies being formed by a cap sheet having longitudinal edges folded up into hems over longitudinal edges of the main body sheet whereby the carrier has the cross-sectional structure of a regular cross tee, end connectors at opposite ends of the carrier web, the cover having a three-dimensional cross-section with an overall width generally equal to the width of the carrier flange and four separate integral bendable tabs, the tabs being disposed on opposite edges of the cover and spaced from the ends of the cover, each tab being short in a lengthwise direction of the cover in comparison to a length of the cover such that the tabs on each edge of the cover are spaced from one another a distance greater than the length of each tab, the tabs by virtue of their short length and wide spacing being constructed to be manually folded over the flange of the carrier to lock the cover to the carrier, the end connectors being integral with the web and readily bendable to temporarily foreshorten the carrier to facilitate assembly between sides of a narrow channel.

5. A narrow utility channel in a suspended ceiling grid formed by a pair of narrowly spaced parallel main runners, the main runners being of a type having an upper hollow reinforcing bulb, a vertical web extending downwardly from the bulb, and a three-dimensional flange at a lower edge of the web, the main runners having cross runner slots longitudinally spaced along their webs, a cross member assembled between said main runners, the cross runner being formed of a carrier part and a cover part, the carrier part having a vertical web and a lower flange at the bottom of the vertical web, the flange comprising two plies, one of the plies being integral with a main body sheet forming an upper hollow reinforcing bulb and said web, the other of said plies being formed by a cap sheet having longitudinal edges folded up into hems over longitudinal edges of the main body sheet whereby the carrier has the cross-sectional structure of a regular cross tee, an end connector at each end of the carrier part, the end connectors being arranged with respect to the main runner slots such that, when the end connectors are properly received in the main runner slots, the carrier part flange is coplanar with a top of the main runner flange, the cover part being arranged to fit on the carrier part flange between the flanges of the main runners, the cover part having two small bendable tabs on each side of the cover and spaced from the ends of the cover, the tabs being short in the longitudinal direction of the cover in comparison to the length of the cover, such that they are spaced from one another a distance greater than the length of each tab on each side of the cover, with the cover abutting the carrier part flange, the tabs are arranged to be manually bent over the carrier part flange while the carrier part end connectors are properly received in the main runner slots to thereby attach the cover part to the carrier part, the cover part having a cross-sectional shape corresponding to a visible portion of the main runner flanges.

* * * * *

UNITED STATES PATENT AND TRADEMARK OFFICE

CERTIFICATE OF CORRECTION

PATENT NO. : 8,991,120 B2
APPLICATION NO. : 13/960042
DATED : March 31, 2015
INVENTOR(S) : James J. Lehane, Jr. et al.

It is certified that error appears in the above-identified patent and that said Letters Patent is hereby corrected as shown below:

On the title page

Item 73 Assignee: USG Interiors, Inc., Chicago, IL (US) should be amended to:

--USG Interiors, LLC, (Chicago, IL (US)--;

In the specification

Column 2, line 38, after "yokes" insert --20--.

Signed and Sealed this
Seventh Day of June, 2016

Michelle K. Lee

Michelle K. Lee
*Director of the United States Patent and Trademark Office*